US005184949A

United States Patent [19]

O'Brien

[11] Patent Number: 5,184,949

[45] Date of Patent: Feb. 9, 1993

[54] OIL BURNER AND METHOD

[75] Inventor: Dennis J. O'Brien, Litchfield, Ohio

[73] Assignee: R. W. Beckett Corporation, North Ridgeville, Ohio

[21] Appl. No.: 579,853

[22] Filed: Sep. 7, 1990

[51] Int. Cl.[5] ..... F23C 5/06

[52] U.S. Cl. ..... 431/189; 431/2; 431/9; 431/252; 431/353

[58] Field of Search ..... 431/189, 2, 6, 9, 190, 431/202, 252, 253, 348, 353; 415/184, 203, 224

[56] References Cited

U.S. PATENT DOCUMENTS 2,491,201 12/1949 O'Donnell et al. .
2,500,787 3/1950 Lelgemann .
3,032,096 5/1962 Stout ..... 431/11
3,918,885 11/1975 Palm et al. .
4,388,064 6/1983 Kaplan et al. .

*Primary Examiner*—Larry Jones
*Attorney, Agent, or Firm*—Watts, Hoffmann, Fisher & Heinke

[57] ABSTRACT

A gun-type oil burner is disclosed having a motor axially aligned with a fuel pump and a blower at opposite ends. The blower draws air into the burner, the amount of which is controlled by an adjustable air gate. The blower inlet is covered by a removable, protective air scoop. Upon removal of the air scoop, an outside air boot is easily connected to the burner without burner modification. The air in the burner travels along a serpentine path which contains smooth curves and perimetrally disposed protrusions for reducing the velocity of the air flow and maintaining its static pressure. The air flows through an air tube in a helical pattern, mixes with oil and is ignited at the air tube outlet. A fuel nozzle, ignitors and a fuel supply conduit are supported as a burner sub-assembly within the tube by a spider. A preselected stop of a number of removable stops of differing sizes is located on the spider and properly positions the burner sub-assembly within the air tube. The burner sub-assembly may be viewed through a window located near the rear of the air tube on the burner assembly.

27 Claims, 6 Drawing Sheets

OIL BURNER AND METHOD

TECHNICAL FIELD

This invention relates to a fuel-fired burner assembly and, more specifically to a gun-type oil burner.

BACKGROUND ART

Conventional gun-type oil burners generally include an air tube having a fuel supply conduit extending axially within the tube. The fuel supply conduit is connected at one end to a fuel pump which supplies oil and terminates at its other end near the end of the air tube in a fuel dispensing nozzle which emits the oil under pressure. The oil is mixed with air which has been delivered by a centrifugal blower. The blower is driven by a motor which in some oil burner models also drives the fuel pump. An ignition transformer located on the oil burner is connected to an ignition apparatus which is located adjacent the fuel nozzle near the end of the air tube. This ignition apparatus ignites the oil-air mixture as it exits the air tube.

Previous oil burners have arranged the blower, motor, and fuel pump in various configurations. Some of the conventional oil burners have the inlet for the blower on the same side as the fuel pump. When bleeding air from the fuel pump, it is possible for air to be sucked into the blower thereby coating it with oil. This in turn causes severe problems with lint buildup.

A previous burner proposal has attempted to reduce the velocity of the flow of combustion air with the use of channels or baffles within the air tube just before the air reaches the location at which it is mixed with the oil and ignited. This may not produce a very substantial reduction in air velocity and can also result in stratification.

In order to adjust the amount of air which the burner takes in, previous proposals utilized a damper on the inlet side of the blower. When this damper is partially closed, thereby restricting the intake of air into the burner, the blower is not able to develop full capacity. This disrupts the flow of air through the burner by causing a small amount of air to flow too fast and without any chance to build up a good, full pressure head. It also contributes to velocity induced air stratification. In addition, such a damper location typically interferes with the connection of an outside air boot.

Moreover, with many prior burners, the location of the blower and fuel pump, as well as the damper, also interferes with the connection of a boot. Accordingly with prior burners, if there is a desire to connect an outside air boot to the burner, various parts of the damper and/or pump may need to be dismantled in order to achieve such a connection.

As with most mechanical apparatus, various rates of operation are desirable. Previous burner proposals have attempted to provide for adjustment of the burning rate by requiring dismantling of various parts and the use of awkward measuring tools. Many proposals require the burning rate to be adjusted at the rear of the burner which complicates measurement and verification of the burning rate at the actual combustion region.

DISCLOSURE OF THE INVENTION

The present invention provides an improved fuel-fired burner, more particularly a gun-type oil burner, that is easily and efficiently operated.

In the preferred embodiment, the burner assembly includes an overall housing with a motor connected to the housing and located near the bottom of the burner assembly. This motor includes an output shaft which is axially aligned with and connected to a blower for intake of air into the burner assembly. A fuel pump is connected to the opposite end of the output shaft at the opposite end of the motor. This allows for separation of the fuel handling system from the air handling system which minimizes contamination of the fuel handling system and collection of oil within the air handling system. By having the fuel pump, motor and blower axially aligned along the bottom of the burner assembly, one motor is easily capable of running both the fuel pump and the blower. This setup also allows for reduced manufacturing cost and easy maintenance.

Major advantages of a burner embodying the invention are provided by an improved air handling system. It is desirable in gun-type oil burners to reduce the velocity of the air flow while maintaining the static pressure of the air at the location where the air is actually mixed with the oil and ignited. As air is delivered to the burner assembly, it travels through a serpentine path which has smooth curves and perimetrally disposed protrusions for directing the air flow while concurrently maintaining the static pressure and reducing the velocity of the air flow without stratification. As air exits the serpentine path, it rounds a smooth flow diverting wall and enters an air tube with at least some of the entering air flowing in a direction forwardly of the air tube causing the air to travel through the air tube in a smooth, helical pattern and minimizing velocity induced air stratification. A constant flow of air is maintained towards the burner outlet at all times during operation of the burner. This entire air handling system smoothly reduces the velocity of the air flow while maintaining the desired, blower-developed static pressure head near the outlet end of the air tube where the air and oil are mixed and ignited. The air handling system creates desired turbulence within the body of air which aids in the mixing of the air and oil and this mixture's ignition.

The air inlet of the blower is partially covered by a removable air scoop, which helps protect against blower-produced injuries and noise emission during operation as well as helping keep foreign matter out of the blower. The scoop is easily removed. Once the scoop is removed, an outside air boot is easily connected to the burner assembly without burner modification.

Aiding in the easy connection of an outside air boot to the burner assembly is the location of an air gate. With the present invention the air gate is located between the blower and the locus where the air is actually being mixed with the oil and ignited. This means an outside air boot may be connected to the burner assembly without adjustment or modification of the air gate.

The location of the air gate also allows for smooth delivery of air to the locus where the air is mixed with the oil and ignited. Because the air gate is located on the outlet side of the blower rather than the inlet side, the blower is not starved and is able to develop full capacity thereby helping reduce high velocity airflow and velocity induced air stratification.

Control of the air gate is also improved with the present invention. A dial is located on the burner assembly for manual adjustment of the air gate. A pinion is connected to the dial and at least a segment of a gear is located on the air gate with the gear and pinion being meshed in a predetermined ratio. This allows for facile, fine adjustment of the air gate.

Easy preselection of a burning rate of the burner assembly is another feature of the present invention. The fuel nozzle and ignition apparatus are connected together and supported by a spider as a burner sub-assembly in the outer end of the air tube. A stop, which is selected at the time of installation of the burner assembly from a number of provided stops of a variety of lengths, is also attached to the burner sub-assembly on the spider. This stop locates the burner sub-assembly in appropriate spacial relationship with the outer end of the air tube and thereby contributes to the control of the burning rate of the burner assembly. The stop length also corresponds to the fuel nozzle which is being used. Whenever maintenance or service is required of the burner sub-assembly, it may be moved, removed or dismantled and upon reinstallation of the burner sub-assembly, the stop will assure proper positioning of the burner sub-assembly in the exact same spacial location near the outer end of the air tube without adjustment or the use of measuring tools.

Another feature of the invention is a window located near the rear of the air tube on the back of the burner assembly which allows for an operator or a serviceman to view the operation of the burner sub-assembly.

Accordingly the objects of the invention are to provide a novel and improved burner assembly and methods of installation, repair and use of such an assembly.

These and other objects of the invention will be better understood from the following description of the invention shown in the accompanying drawings.

DESCRIPTION OF THE PREFERRED EMBODIMENT

Figure 1:
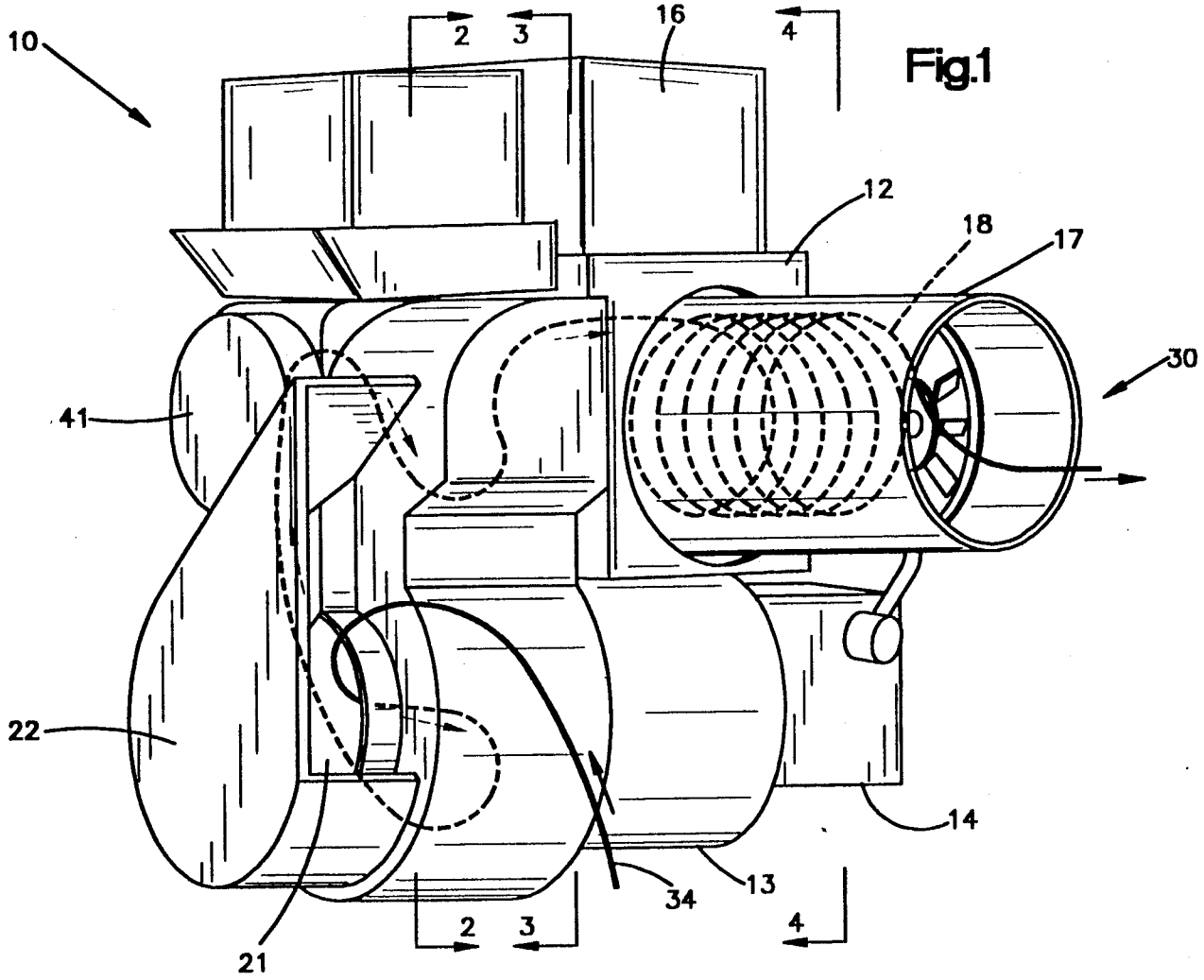
FIG. 1 is a perspective view of a gun type oil burner constructed according to a preferred embodiment of the invention.

A fuel oil burner 10 embodying the present invention is illustrated by the drawings as a gun type oil burner for mounting on a furance by a mounting flange 11. Referring to FIG. 1, the new oil burner 10 comprises a housing 12 and a motor 13 located near the bottom of the housing 12. A fuel pump 14 is mounted on one end of the motor 13 and a blower 15 is mounted on the opposite end of the motor 13. A transformer 16 is located near the top of the housing 12. An air tube 17 defining an air flow path 18 projects outward from the housing 12.

The motor 13 has one end of its output shaft 20 axially aligned with and connected to the fuel pump 14 and its other end axially aligned with and connected to the blower 15 thereby allowing the motor 13 to operate both the fuel pump 14 and the blower 15.

Figure 2:
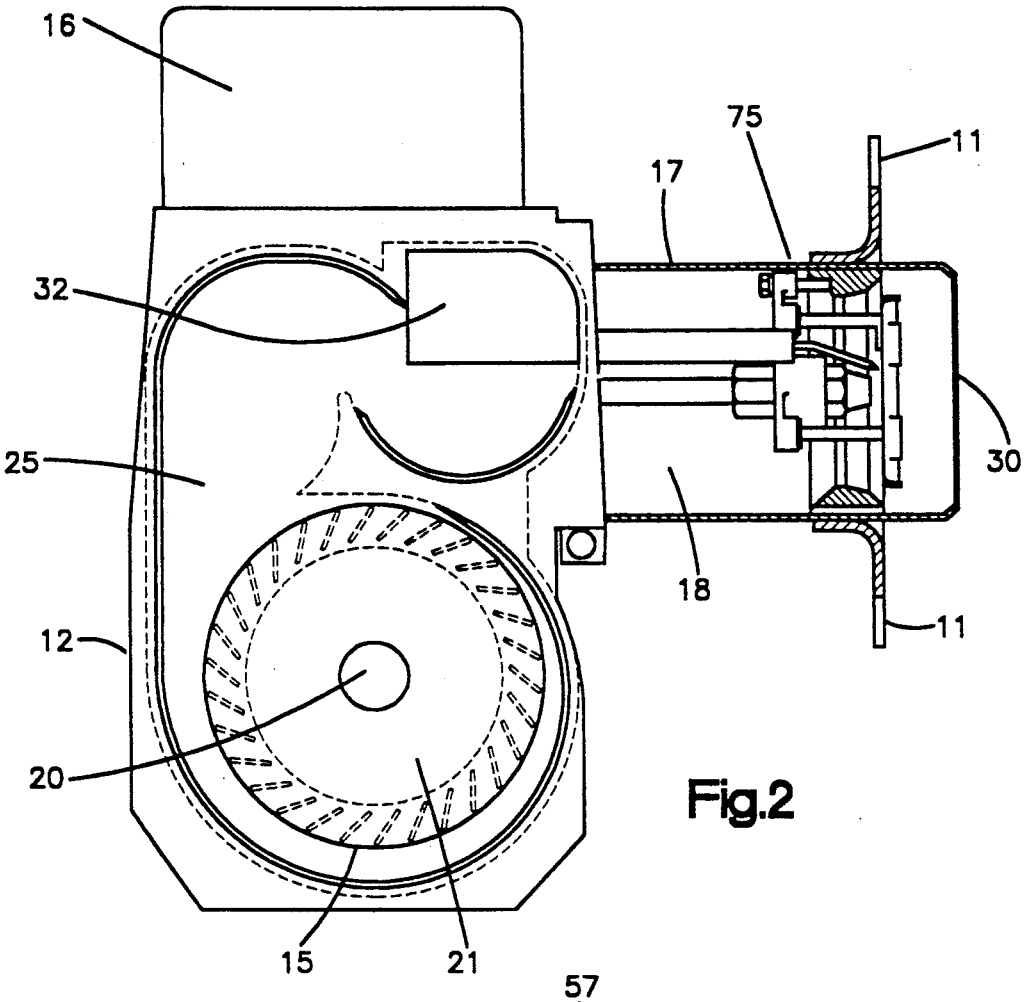
FIG. 2 is an elevational view of the gun-type oil burner with a portion of the housing removed and includes a sectional view of the burner sub-assembly within the air tube and a view of the air flow passage within the burner as seen from the plane indicated by the line 2—2 of FIG. 1.
Figure 7:
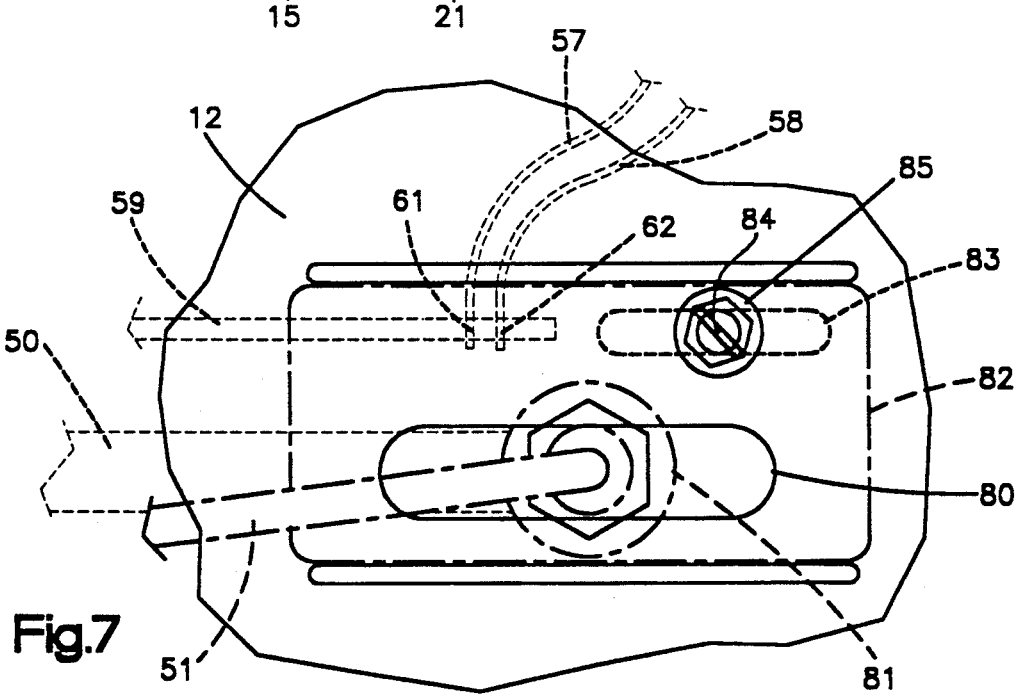
FIG. 7 is an enlarged elevational view of the access slot of the oil burner.

As seen from the orientation of FIG. 2, the motor 13 rotates the blower 15 in a clockwise rotation pulling air through a blower inlet 21. The air travels along a path 34 as shown in FIG. 1. The blower inlet 21 is partially covered by a removable padded air scoop 22 that helps guide the air into the blower inlet 21 and is also helpful for protecting against blower produced injuries and preventing foreign matter from entering the blower. It also reduces noise emitted during operation.

Figure 3:
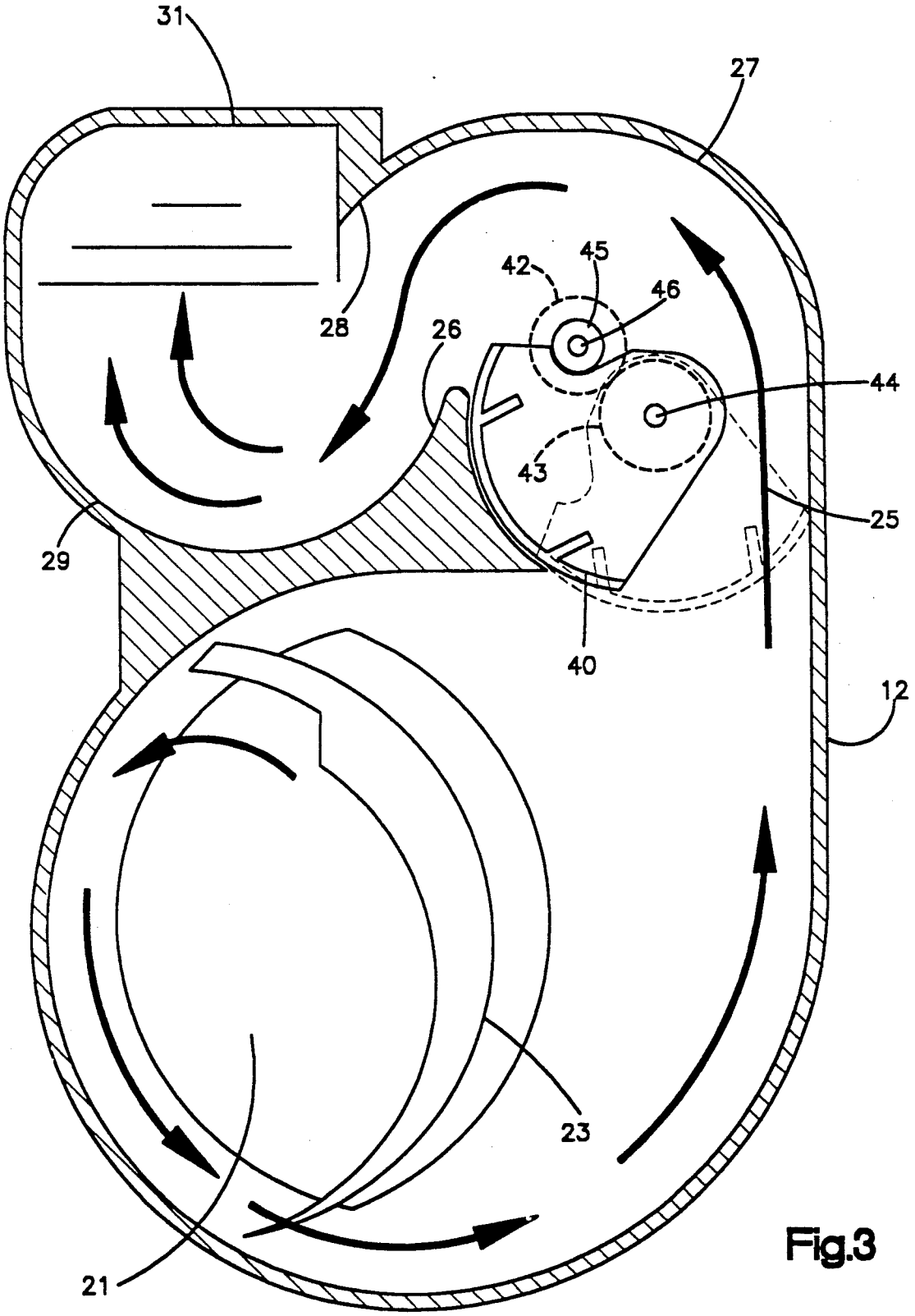
FIG. 3 is a sectional view showing on an enlarged scale the air flow passage within the gun type oil burner as seen from the plane indicated by the line 3—3 of FIG. 1.

Referring to FIG. 3, an air guide 23 located on the suction side of the blower 15 helps direct the air flow on both the pressure side and suction side of the blower thereby helping the blower 15 produce improved static pressure. The air exits the blower and travels along a serpentine air flow passage 25 within the housing 12. The path is in part bounded by perimetrally disposed protrusions 26, 28 and has smooth curves 27, 29. The serpentine air flow passage 25 reduces the velocity of the air flow and maintains the static pressure developed by the blower 15.

Throughout the air flow passage 25, the air is flowing forwardly towards an outlet 30 of the air tube 17. The air then engages a flow diverting wall 31 in an upward direction and enters the air tube 17 at air tube inlet 32 with at least some of the body of air flowing in a direction forwardly of the tube causing the air to travel in a smooth, helical pattern through the air flow path 18 of the air tube 17 towards the outlet 30 of the air tube 17. The helical air flow passes through a burner head section 33 just before it exits through the air tube outlet 30.

The amount of air that travels through the air flow passage 25 is controlled by an air gate 40 which is shown in FIG. 3. The air gate is controlled by a dial 41 that is located externally on the housing 12 as shown in FIG. 1. A pinion 42, connected to the dial 41, is meshed in a predetermined ratio with a gear segment 43 located on the air gate 40. By rotating the dial 41, the air gate 40 is rotated about a shaft 44 thereby adjusting the amount of air which travels through the air flow passage 25. A boss 45 surrounds a shaft 46 of the dial 41 and limits the movement of the air gate 40.

Figure 4:
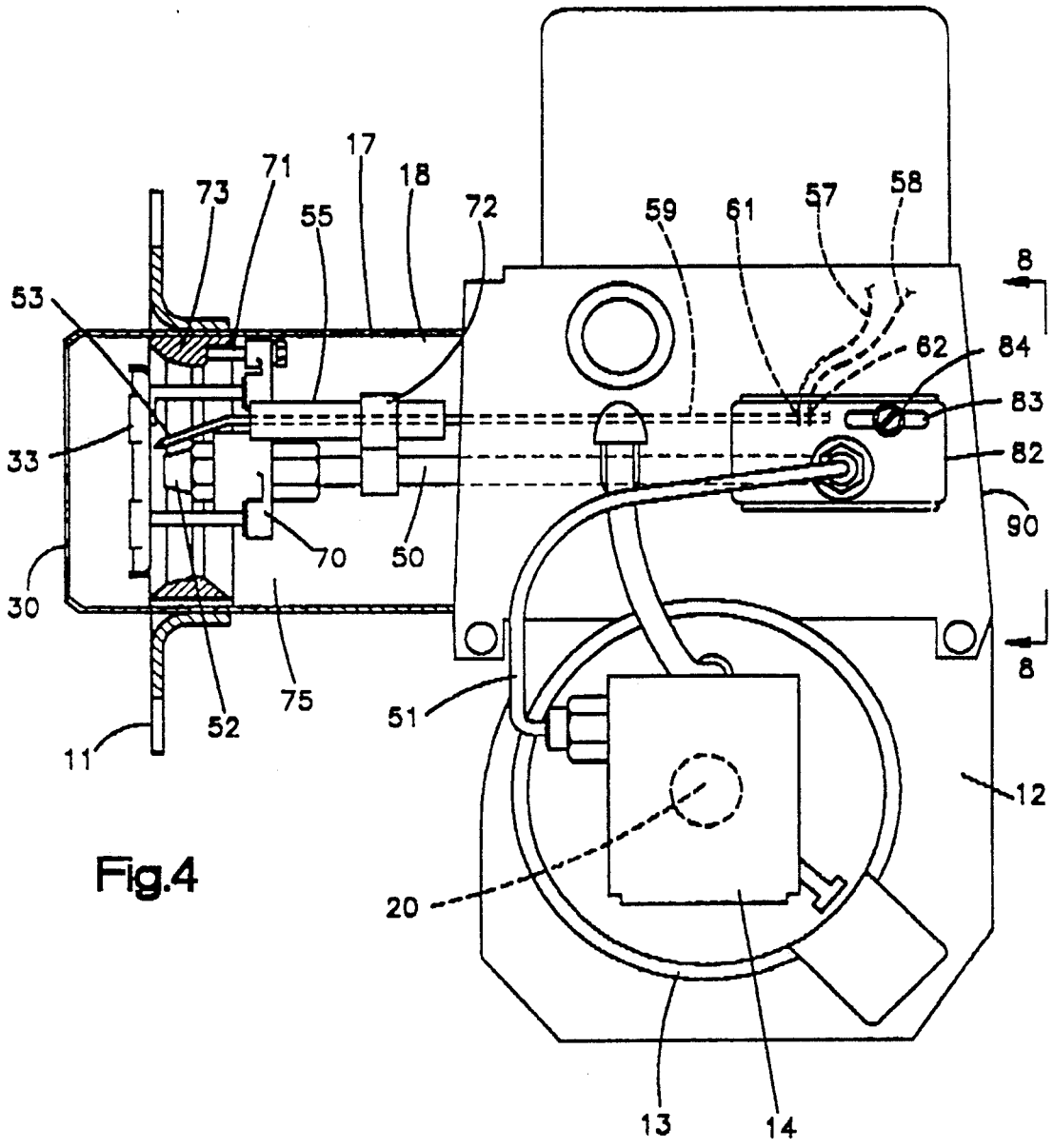
FIG. 4 is an elevational view of a gun type oil burner as seen from the plane indicated by the line 4—4 of FIG. 1 and includes a sectional view of the burner sub-assembly contained within the air tube of the oil burner.
Figure 5:
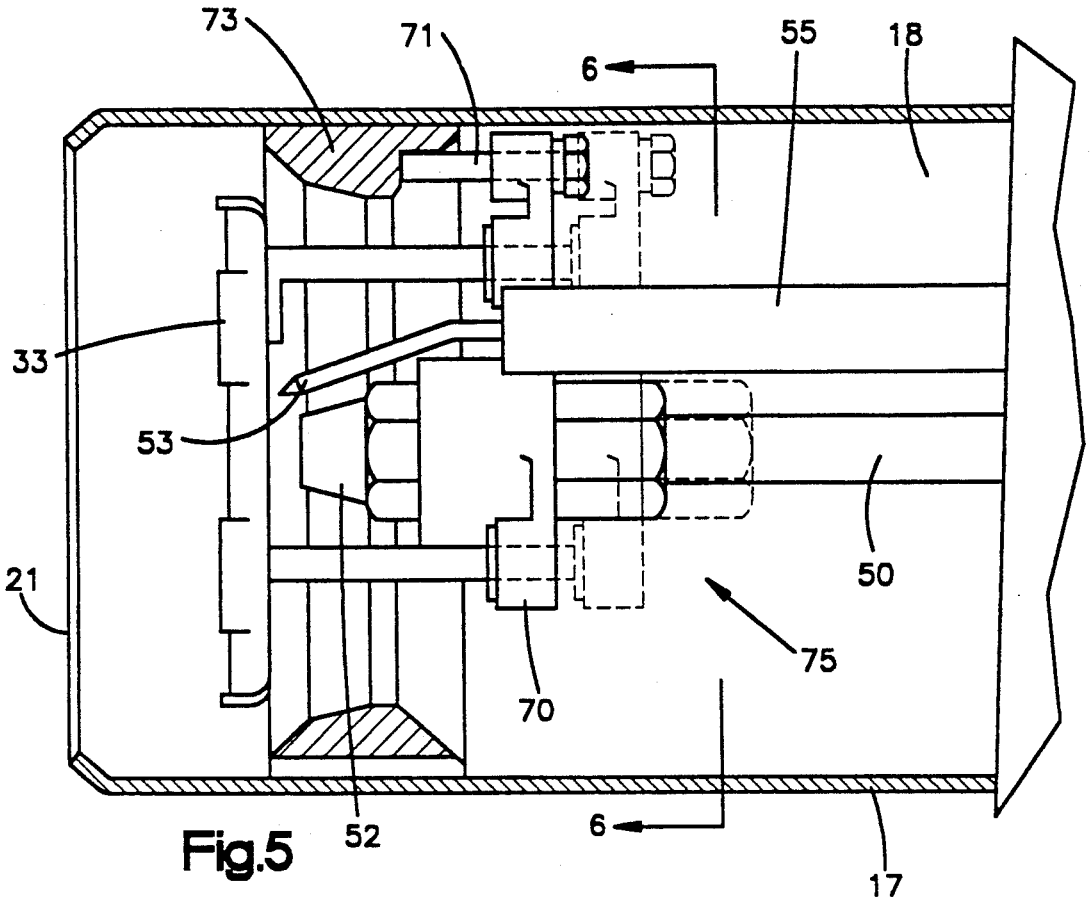
FIG. 5 is an enlarged sectional view of the burner sub-assembly and the air tube.
Figure 6:
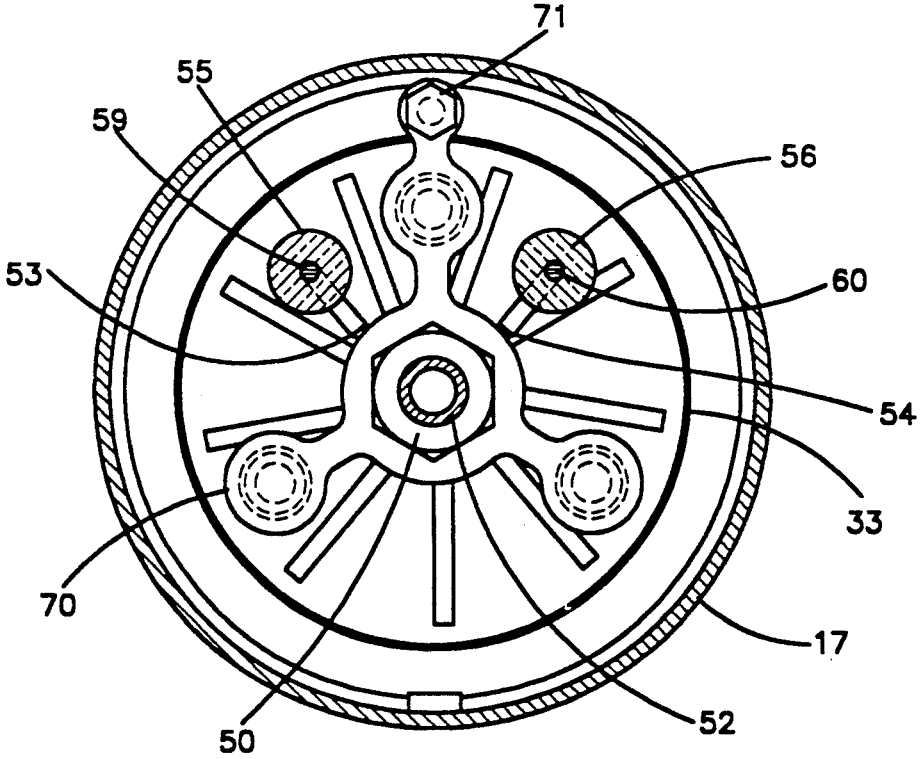
FIG. 6 is a sectional view of the burner sub-assembly as seen from the plane indicated by the line 6—6 of FIG. 5.

Referring to FIGS. 4 and 5, the motor 13 operates the fuel pump 14 supplying oil to a fuel supply conduit 50 via a fuel supply pipe 51. The oil travels through the conduit 50 to the burner nozzle 52 located near the tube outlet 30 where it is emitted under pressure in a fine mist and mixed with the air that has reached the burner head section 33.

The fuel-air mixture is ignited by ends 53, 54 of ignitors 55, 56 located near the burner head section 33. The ignitors 55, 56 are connected to the transformer 16 via cables 57, 58 that clip onto rods 59, 60 extending from the ignitors 55, 56 past the air tube inlet 32 toward an access port door 91. Each of the clips 61, 62 consist of a U shaped band which flexes to accommodate the diameter of the corresponding rod to which it is connected.

The burner nozzle 52, the fuel supply conduit 50 and the burner head section 33 are supported within the air tube 17 by a spider 70. A stop 71 of appropriate length corresponding to the desired burning rate and burner nozzle 52 is connected to and located at the top of the spider 70.

The ignitors 55, 56 are connected to the fuel supply conduit 50 by a T shaped bracket 72. The T shaped bracket 72 and the spider 70 together rigidly support the burner head section 33, the fuel supply conduit 50, the burner nozzle 52, the ignitors 55, 56 and the stop 71 as one unit, hereinafter referred to as a burner sub-assembly 75. In order to obtain the desired burning rate which corresponds with the length of the stop 71, the burner sub-assembly 75 is moved towards the tube outlet 30 until the stop 71 comes into contact with a coacting tube surface 73.

The fuel supply conduit 50 curves through a slot 80 in the housing 12 and a hole 81 in a separate plate 82 where it is connected to fuel supply pipe 51. The plate 82 is capable of moving with the burner sub-assembly 75 due to a slot 83 through which a screw 84 is inserted to attach the plate 82 to the housing 12. When the burner sub-assembly 75 and plate 82 are in proper position as determined by the stop 71, the screw 84 is screwed into hole 85 located on the housing 12 thereby affixing the plate 82 to the housing 12 and holding the burner sub-assembly 75 in place.

Figure 8:
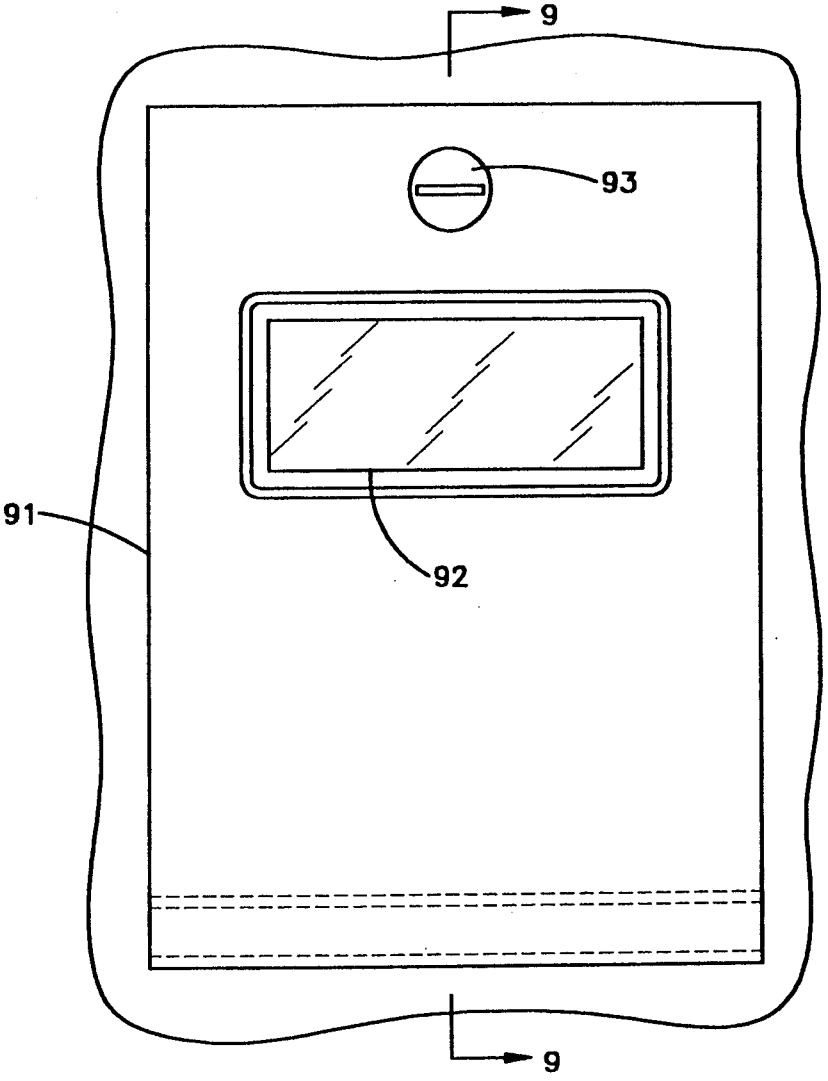
FIG. 8 is an enlarged plane view of the access port seen from the plane indicated by the line 8—8 of FIG. 4.
Figure 9:
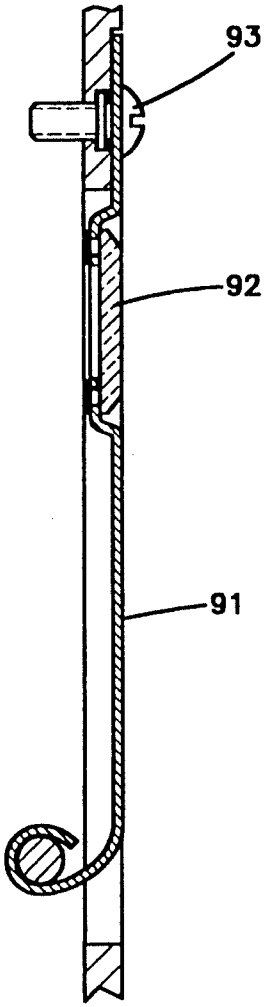
FIG. 9 is a sectional view of the access port door as seen from the plane indicated by the line 9—9 of FIG. 8.

The housing 12 has an access port 90 axially aligned with the air tube 17 at its inlet end. The access port has an access port door 91, shown in FIGS. 8, 9, that is capable of being opened and closed thereby allowing for removal of the burner sub-assembly upon removal of the cables 57, 58. The access port door 91 has a window 92 which allows the burner sub-assembly to be viewed when the access port door 91 is closed. When closed, the access port door 91 is secured by a screw 93.

While a single preferred embodiment of the invention has been illustrated and described in detail, the present invention is not to be considered limited to the precise construction disclosed. Various adaptations, modifications and uses of the invention may occur to those skilled in the art to which the invention relates and the intention is to cover hereby all such adaptations, modifications and uses which fall within the spirit or scope of the appended claims.

Having described my invention, I claim:

1. In an oil burner including an air tube defining an elongate air flow path extending from an inlet to an outlet, a housing, a motor driven blower connected to said housing near the inlet end of said air tube, said housing defining an air flow passage between an outlet of said blower and the inlet of said air tube, a burner nozzle near the outlet of said air tube, and oil supply means for said nozzle, the improvement comprising:

a) said air flow passage being of serpentine form and maintaining a component of air flow forwardly from the blower outlet toward the outlet of said air tube, whereby the velocity of air flow in said passage is decreased while maintaining static pressure;

b) an adjustable air gate mounted in said housing for controlling the amount of air which flows along the air flow passage; and c) said inlet of said air tube being located such that air from said flow passage enters said air tube and then moves through said tube in a generally helical pattern toward said outlet of said tube.

2. The improvement as claimed in claim 1 wherein said blower is located below a horizontal plane located by the center line of said air tube when the burner is in use.

3. The improvement as claimed in claim 1 wherein said adjustable air gate is located on the pressure side of said blower and has control means including:

a) a dial located externally of and connected to said housing;

b) a pinion connected to said dial; and, c) at least a segment of a gear connected to said air gate, said gear being meshed in a predetermined ratio with said pinion thereby allowing for fine adjustment of the amount of air which enters said air tube.

4. In an oil burner including an air tube defining an elongate air flow path extending from an inlet to an outlet, a housing, a motor driven blower connected to said housing near the inlet end of said air tube, said housing defining an air flow passage between an outlet of said blower and the inlet of said air tube, a burner nozzle near the outlet of said air tube, and oil supply means for said nozzle, the improvement comprising:

a) an adjustable air gate mounted in said housing on the pressure side of said blower for controlling the amount of air that flows along the air flow passage; and, b) the air gate having a control means including:

i) a dial located externally of and connected to said housing;

ii) a pinion connected to said dial; and, iii) at least a segment of a gear located on said air gate, said gear being meshed in a predetermined ratio with said pinion thereby allowing for fine adjustment of the amount of air which enters said air tube.

5. In an oil burner including an air tube defining an elongate air flow path extending from an inlet to an outlet, a housing, a motor driven blower connected to said housing near the inlet end of said air tube, said housing defining an air flow passage between an outlet of said blower and the inlet of said air tube, a burner nozzle near the outlet of said air tube, oil supply means for said nozzle, and an oil-air ignitor for igniting an oil-air mixture near said nozzle, the improvement comprising:

a) said nozzle, oil supply means and oil-air ignitor being a connected assembly that is selectively positionable at a selected one of a plurality of positions spaced axially of said air tube, the connected assembly comprising:

i) an oil tube within said air tube;

ii) said nozzle being connected in fuel delivery relationship with said oil tube; and, iii) mounting means connecting said ignitor to said oil tube;

b) cooperating stop means on said air tube and said connected assembly for locating said connected assembly at a preselected one of said plurality of positions; and, c) said stop means including a removable member carried by a selected one of said connected assembly and said air tube and a coacting surface on the other of said connected assembly and said air tube, said stop member being a preselected one of a set of removable stop members of differing sizes, each adapted to locate said connected assembly at a different one of said plurality of said positions than other stop members of the set.

6. In an oil burner including an air tube defining an elongate air flow path extending from an inlet to an outlet, a housing, a motor driven blower connected to said housing near the inlet end of said air tube, said housing defining an air flow passage between an outlet of said blower and the inlet of said air tube, a burner nozzle near the outlet of said air tube, oil supply means for said nozzle, and an oil-air ignitor for igniting an oil-air mixture, the improvement comprising:

a) said air flow passage being of serpentine form and maintaining a component of air flow forwardly from the blower outlet toward the outlet of said air tube, whereby the velocity of air flow in said passage is decreased while maintaining static pressure;

b) an adjustable air gate mounted in said housing for controlling the amount of air which flows along the air flow passage;

c) said inlet of said air tube being near its top, whereby air from said flow passage enters said air tube and then moves through said tube in a generally helical pattern toward said outlet of said tube;

d) said nozzle, oil supply means and oil-air ignitor being a connected assembly that is selectively positionable at a selected one of a plurality of positions spaced axially of said air tube, the connected assembly comprising:

i) an oil tube within said air tube;

ii) said nozzle being connected in fuel delivery relationship with said oil tube;

iii) said ignitor being connected to said oil tube; and, iv) cooperating stop means on said air tube and said connected assembly for locating said connected assembly at a preselected one of said plurality of positions;

v) said stop means including a removable member carried by one of said connected assembly and said air tube and a coacting surface on the other of said connected assembly and said air tube, said stop member being a preselected one of a set of removable stop members of differing sizes, each adapted to locate said connected assembly at a different one of said plurality of positions than other stop members of the set.

7. In an oil burner including an air tube defining an elongate air flow path extending from an inlet to an outlet, a housing, a motor driven blower connected to said housing near the inlet end of said air tube, said housing defining an air flow passage between an outlet of said blower and the inlet of said air tube, a burner nozzle near the outlet of said air tube, and oil supply means for said nozzle, the improvement wherein the inlet of said blower is partially covered by a removable air scoop thereby protecting against blower produced injuries and reducing the noise emitted from the blower during operation, said blower and said air scoop being located such that upon removal of said air scoop a fresh air duct may be directly connected to said oil burner at the inlet of said blower.

8. In an oil burner including an air tube defining an elongate air flow path extending from an inlet to an outlet, a housing, a motor driven blower connected to said housing near the inlet end of said air tube, said housing defining an air flow passage between an outlet of said blower and the inlet of said air tube, a burner nozzle near the outlet of said air tube, and oil supply means for said nozzle, the improvement wherein:

a) a mounting flange is located on said air tube near its outlet for connecting said oil burner to a furnace or similar apparatus; and, b) said oil supply means, said motor and said blower are respectively aligned along the bottom of said housing and below said air tube thereby allowing easy access to all three for maintenance and service when said oil burner is connected to said furnace.

9. In an oil burner including an air tube defining an elongate air flow path extending from an inlet to an outlet, a housing, a motor driven blower connected to said housing near the inlet end of said air tube, said housing defining an air flow passage between the outlet of said blower and the inlet of said air tube, a burner nozzle near the outlet of said air tube, oil supply means for said nozzle, and an oil-air ignitor for igniting an oil-air mixture, the improvement comprising:

a) said air flow passage being of serpentine form and maintaining a component of air flow forwardly from the blower outlet toward the outlet of said air tube, whereby the velocity of air flow in said passage is decreased while maintaining static pressure;

b) an adjustable air gate mounted in said housing on the pressure side of said blower for controlling the amount of air which flows along the air flow passage;

c) said inlet of said air tube being near its top, whereby air from said flow passage enters said air tube and then moves through said tube in a generally helical pattern toward said outlet of said tube;

d) said adjustable air gate having control means including:

i) a dial located externally of and connected to said housing;

ii) a pinion connected to said dial; and, iii) at least a segment of a gear connected to said air gate, said gear being meshed in a predetermined ratio with said pinion thereby allowing for fine adjustment of the amount of air which enters said air tube;

e) said nozzle, oil supply means and oil-air ignitor being a connected assembly that is selectively positionable at a selected one of a plurality of positions spaced axially of said air tube, the connected assembly comprising:

i) an oil tube within said air tube;

ii) said nozzle being connected in fuel delivery relationship with said oil tube;

iii) said ignitor being connected to said oil tube;

iv) cooperating stop means on said air tube and said connected assembly for locating said connected assembly at preselected one of said plurality of positions; and v) said stop means including a removable member carried by one of said connected assembly and said air tube and a coacting surface on the other of said connected assembly and said air tube, said stop member being a preselected one of a set of removable stop members of differing sizes, each adapted to locate said connected assembly at a different one of said plurality of positions than other stop members of the set;

f) a mounting flange is located on said air tube near its outlet for connecting said oil burner to a furnace or similar apparatus;

g) said oil supply means, said motor and said blower are respectively aligned along the bottom of said housing and below said air tube thereby allowing easy access to all three for maintenance and service when said oil burner is connected to said furnace;

h) said blower is located below the center line of said air tube;

i) said housing includes:

i) an access port axially aligned with said air tube and positioned with the air tube inlet between the port and the outlet;

ii) door means for closing said access port; and, iii) at least a portion of the door means being a window for viewing the ignition of said oil-air mixture when said door means is closed;

j) the inlet of said blower is partially covered by a removable air scoop thereby protecting against blower produced injuries and reducing the noise emitted from the blower during operation, said blower and said air scoop being located such that upon removal of said air scoop a fresh air duct may be directly connected to said oil burner at the inlet of said blower; and, k) an air guide is located near the blower inlet for directing air flow on both the pressure side and the suction side thereby improving the static pressure of the air flow.

10. In an oil burner having an air tube defining an elongate air flow path extending from a tube inlet to an outlet, the tube projecting laterally from a housing and a blower for supplying air under pressure to the tube, the housing defining an air flow passage extending from a blower outlet to the air flow path inlet, the housing comprising:

a) a section defining an air flow passage portion extending from an outlet of the blower forwardly to the tube inlet, the passage portion being generally parallel to and laterally offset from the tube flow path;

b) the section including perimetrally disposed protrusions projecting into the passage portion to induce perimetral air flow turbulence when the burner is in operation whereby to reduce the velocity head and allow the blower to develop a desired pressure head in a body of air flowing through the passage portion;

c) said passage portion being of sufficient transverse dimension end to end that a central part of the passage portion contains a central substantially laminar air flow portion of the flowing body of air, the laminar portion extending from the blower outlet to the tube inlet when the burner is in operation with said protrusions having little effect on the central portion flow conditions;

d) the housing including a flow diverting wall part near the tube inlet for diverting such flowing body of air into the tube while maintaining substantially laminar conditions in said central portion of the body when the burner is in use; and, e) said diverting wall part and the tube inlet being positioned such that flow of such body of air when the burner is in operation enters the tube with at least some of the body of air flowing in a direction forwardly of the tube to produce helical air flow along the tube while at the same time the protrusions produce perimetral velocity reductions in such body to substantially avoid velocity induced air stratification.

11. An oil burner comprising:

a) an elongate tubular air tube defining a flow path extending from an inlet to a spaced outlet;

b) a spider mounted fuel conduit and nozzle positioned centrally in the tube with the nozzle near the outlet;

c) a mounting flange connected to the tube when the burner is in use;

d) a housing connected to the tube near the inlet;

e) a blower journaled on and positioned within the housing; and, f) the housing defining an airflow passage extending from a blower outlet to the tube inlet, the housing comprising:

i) a section defining an air flow passage portion extending from an outlet of the blower forwardly to the tube inlet, the passage portion being generally parallel to and laterally offset from the tube flow path;

ii) the section including perimetrally disposed protrusions projecting into the passage portion to induce perimetral air flow turbulence when the burner is in operation whereby to reduce the velocity head of a perimetral portion of a body of air flowing through the passage portion;

iii) said passage portion being of sufficient transverse dimension end to end that a central part of the passage portion contains a central substantially laminar air flow portion of the flowing body of air, the laminar portion extending from the blower outlet to the tube inlet when the burner is in operation with said protrusions having little effect on the central portion laminar flow conditions;

iv) the housing including a flow diverting wall part near the tube inlet for diverting such flowing body of air into the tube while maintaining substantially laminar conditions in said central portion of the body when the burner is in use; and, v) said diverting wall part and the tube inlet being positioned such that flow of such body of air when the burner is in operation enters the tube with at least some of the body of air flowing in a direction forwardly of the tube to produce helical air flow along the tube while at the same time the protrusions produce perimetral velocity reductions in such body to substantially avoid velocity induced air stratification.

12. An oil burner as described in claim 11 wherein an adjustable air gate is located along the airflow passage for controlling the amount of air which enters the tube inlet, the control being accomplished by a dial located on the housing, the dial being connected to a pinion which is meshed with at least a segment of a gear located on the air gate in a predetermined ratio thereby allowing for facile fine adjustment of the amount of air which enters the air tube.

13. An oil burner as described in claim 11 wherein a removable air scoop partially covers a blower inlet thereby protecting against blower produced injuries and reducing the noise emitted from the blower during operation, the inlet defining portions being constructed such that upon removal of the air scoop an outside air boot may be directly connected over the blower inlet without any further manipulation of said oil burner.

14. An oil burner as described in claim 11 wherein the housing includes an access port and the access port includes a window axially aligned with the tube for viewing the nozzle and flames produced when the burner is in use.

15. An oil burner as described in claim 11 wherein a removable stop carried by said spider and engaging a coacting tube surface to locate said nozzle at a desired location axially of the tube, wherein the stop is a preselected one of a number of removable stops of differing sizes each adapted to provide a nozzle location axial of the tube different than the remaining stops.

16. An oil burner comprising:

a) an elongate tubular air tube defining a flow path extending from an inlet to a spaced outlet;

b) a spider mounted fuel conduit and nozzle positioned centrally in the tube with the nozzle near the outlet;

c) a mounting flange connected to the tube when the burner is in use and adapted to connect the tube to a furnace;

d) a housing connected to the tube near the inlet;

e) a blower journaled on and positioned within the housing; and, f) the housing defining an airflow passage extending from a blower outlet to the tube inlet, the housing comprising:

i) a section defining an air flow passage portion extending from an outlet of the blower forwardly to the tube inlet, the passage portion being generally parallel to and laterally offset from the tube flow path;

ii) the section including perimetrally disposed protrusions projecting into the passage portion to induce perimetral air flow turbulence when the burner is in operation whereby to reduce the velocity head of a perimetral portion of a body of air flowing through the passage portion;

iii) said passage portion being of sufficient transverse dimension end to end that a central part of the passage portion contains a central substantially laminar air flow portion of the flowing body of air, the laminar portion extending from the blower outlet to the tube inlet when the burner is in operation with said protrusions having little effect on the central portion laminar flow conditions;

iv) the housing including a flow diverting wall part near the tube inlet for diverting such flowing body of air into the tube while maintaining substantially laminar conditions in said central portion of the body when the burner is in use; and, v) said diverting wall part and the tube inlet being positioned such that flow of such body of air when the burner is in operation enters the tube with at least some of the body of air flowing in a direction forwardly of the tube to produce helical air flow along the tube while at the same time the protrusions produce perimetral velocity reductions in such body to substantially avoid velocity induced air stratification;

g) an adjustable air gate located along the airflow passage for controlling the amount of air which enters the tube inlet, the control being accomplished by a dial located on the housing, the dial being connected to a pinion which is meshed with at least a segment of a gear located on the air gate in a predetermined ratio thereby allowing for facile fine adjustment of the amount of air which enters the air tube.

17. An oil burner comprising:

a) an elongate tubular air tube having an inlet and a spaced outlet;

b) a spider mounted fuel conduit and nozzle positioned centrally in the tube with the nozzle near the outlet;

c) a mounting flange connected to the tube when the burner is in use and adapted to connect the tube to a furnace;

d) a housing connected to the tube near the inlet;

e) a blower journaled on and positioned within the housing;

f) the housing defining an airflow passage extending from a blower outlet to the tube inlet;

g) an adjustable air gate located along the airflow passage for controlling the amount of air which enters the tube inlet, the control being accomplished by a dial located on the housing, the dial being connected to a pinion which is meshed with at least a segment of a gear located on the air gate in a predetermined ratio thereby allowing for facile fine adjustment of the amount of air which enters the air tube.

18. An oil burner comprising:

a) an elongate tubular air tube having an inlet and a spaced outlet;

b) a spider mounted fuel conduit and nozzle positioned centrally in the tube with the nozzle near the outlet;

c) a mounting flange connected to the tube when the burner is in use and adapted to connect the tube to a furnace;

d) a housing connected to the tube near the inlet;

e) a blower journaled on and positioned within the housing;

f) the housing defining an airflow passage extending from a blower outlet to the tube inlet;

g) the housing also having portions defining a blower inlet; and, h) a removable air scoop partially covering the blower inlet thereby protecting against blower produced injuries and reducing the noise emitted from the blower during operation, the blower inlet defining portions being constructed such that upon removal of the air scoop an outside air boot may be directly connected over the blower inlet without any further manipulation of said oil burner.

19. An oil burner comprising:

a) an elongate tubular air tube having an inlet and a spaced outlet;

b) a spider mounted fuel conduit and nozzle positioned centrally in the tube with the nozzle near the outlet;

c) a mounting flange connected to the tube when the burner is in use and adapted to connect the tube to a furnace;

d) a housing connected to the tube near the inlet;

e) a blower journaled on and positioned within the housing;

f) the housing defining an airflow passage extending from a blower outlet to the tube inlet;

g) said housing including an access port; and, h) the port including a window axially aligned with the tube for viewing the nozzle and flames produced when the burner is in use.

20. The burner of claim 19 further including:

a) an access port axially aligned with said air tube and positioned with the air tube inlet between the port and the outlet;

b) door means for closing said access port; and,
c) at least a portion of the door means being a window for viewing the ignition of said oil-air mixture when said door means is closed.

21. An oil burner comprising:
a) an elongate air burner tube having an inlet and a spaced outlet;
b) a spider mounted fuel conduit and nozzle positioned centrally in the tube with the nozzle near the outlet;
c) a mounting flange connected to the tube when the burner is in use and adapted to connect the tube to a furnace;
d) a housing connected to the tube near the inlet;
e) a blower journaled on and positioned with the housing;
f) the housing defining an airflow passage extending from a blower outlet to the tube inlet;
g) the tube defining a geometric volume, the blower being positioned when the burner is in use below an imaginary extension of the geometric volume and outwardly from a furnace relative to the tube;
h) a motor mounted on the housing in depending relationship when the burner is in use;
i) the motor having a housing and an output shaft having spaced end portions projecting from opposite sides of the motor housing;
j) one end portion of the shaft being axially aligned with and connected to the blower;
k) a fuel pump connected to the other of the shaft end portions in axial alignment; and,
l) said motor and fuel pump being positioned below said imaginary extension of the geometric volume and the fuel pump and blower being spaced from one another whereby to facilitate service and repair of the blower, motor and fuel pump and to inhibit fuel contamination of the blower.

22. An oil burner comprising:
a) an elongate tubular air tube having an inlet and a spaced outlet;
b) a spider mounted fuel conduit and nozzle positioned centrally in the tube with the nozzle near the outlet;
c) a mounting flange connected to the tube when the burner is in use and adapted to connected the tube to a furnace;
d) a housing connected to the tube near the inlet;
e) a blower journaled on and positioned with the housing;
f) the housing defining an airflow passage extending from a blower outlet to the tube inlet;
g) a removable stop carried by the spider and engaging a coacting tube surface to locate the nozzle at a desired location axially of the tube; and,
h) said stop being a pre-selected one of a number of removable stops of differing sizes each adapted to provide a nozzle location axial of the tube different than the remaining stops.

23. An oil burner, comprising:
a) a housing;
b) a motor connected to the housing located near the bottom of the burner;
c) the motor includes an output shaft;
d) a blower for intake of air into the burner, the blower being axially aligned with and connected to the motor shaft;
e) a fuel pump connected to the shaft and mounted on the motor opposite the blower;
f) an air tube projecting outward from said burner including a burner sub-assembly located within the tube, the tube being connected to said housing and being located over and laterally offset from the blower, the burner sub-assembly including:
i) a spider positioned in the tube;
ii) a fuel nozzle supported in the tube by the spider;
iii) a fuel supply conduit connected to and terminating in the fuel nozzle;
iv) an ignition apparatus connected to the fuel supply conduit with a T shaped bracket;
v) a burner head section supported in the tube by the spider and in a preselected space relationship with the fuel nozzle and the ignition apparatus; and,
vi) a positive stop carried by said spider, the stop is a preselected one of a number of stops of differing lengths selected during installation of the burner and the stop engages a coacting tube surface thereby locating the burner sub-assembly thereby contributing to the control of the burning rate of the burner;
g) a window located opposite the outward most end of said burner sub-assembly through which the burner head section, said fuel nozzle and said ignition apparatus may be observed;
h) air guidance means for guiding air supplied by said blower through the burner upwardly along a serpentine air flow passage in which the air is guided by perimetrally disposed protrusions, engages a flow diverting wall and enters said air tube;
i) an adjustable air gate positioned along the path between said blower and the air tube and for controlling the amount of air entering the air tube; and,
j) a dial, a pinion connected to the dial, at least a segment of a gear connected to the air gate, said pinion and said gear being meshed in a predetermined ratio whereby to provide facile fine adjustment of the air gate;
k) a removable air scoop partially covering a blower inlet, the air scoop being removable to permit an outside air boot to be connected directly to the blower inlet.

24. A process of installing a fuel burner with a flame producing capacity appropriate for the installation comprising:
a) determining an appropriate axial location for a nozzle in an air tube;
b) selecting a stop of a size appropriate to locate the nozzle in the determined location, the selection being from a set of stops each of a size different than the remainder of the set;
c) connecting the selected stop to the nozzle; and,
d) locating a nozzle in an air tube by bringing the stop into contact with a coacting tube surface.

25. The process of claim 24 wherein the stops of the set are threaded and the selected stop is connected to the nozzle by threadably connecting the stop to a nozzle supporting spider.

26. The process of claim 24 wherein the nozzle locating step includes sliding the nozzle and a nozzle support forwardly in the tube until the stop engages the coacting tube surface.

27. A process of operating a fuel burner with minimized air stratification comprising:
a) operating a blower to introduce air into a passage and establish flow of a body of air along the passage;

b) causing turbulence in a perimetral portion of the body to reduce the velocity head while maintaining the static head of perimetral portions of the body developed by the blower while concurrently establishing and maintaining substantially laminar flow conditions about a flow axis in a central portion of the passage;

c) laterally diverting the flow from the passage into an air tube having a tube axis generally paralleling but laterally offset from the flow axis;

d) the diverting step including diverting the air into the tube while maintaining a central portion having substantially laminar flow along a further axis oriented to establish helical air flow along inner surfaces of the tube; and, e) the helical flow having an air advancing component in a direction toward an ignition end of the tube.

* * * * *